United States Patent [19]

Taylor

[11] 3,999,531

[45] Dec. 28, 1976

[54] COLD ENGINE STARTING

[75] Inventor: Iain M. Taylor, Dedham, Mass.

[73] Assignee: J. H. Westerbeke Corporation, Avon, Mass.

[22] Filed: Aug. 20, 1975

[21] Appl. No.: 606,009

Related U.S. Application Data

[63] Continuation of Ser. No. 472,353, May 22, 1974.

[52] U.S. Cl. ..... 123/196 M; 123/179 R; 123/179 F

[51] Int. Cl.[2] ..... F01M 1/00

[58] Field of Search ..... 123/187.5 R, 179 F, 123/179 BG, 179 R, 196 M, 180 R; 184/6.8

[56] References Cited

UNITED STATES PATENTS

| | | | |
|---|---|---|---|
| 1,904,936 | 4/1933 | Stokes | 261/39 D |
| 2,194,007 | 3/1940 | Clementson | 123/196 M |
| 3,297,011 | 1/1967 | Gray | 123/180 R X |
| 3,827,417 | 8/1974 | Morita | 123/127 |
| 3,911,890 | 10/1975 | Ansdale | 123/179 H |

FOREIGN PATENTS OR APPLICATIONS

| | | | |
|---|---|---|---|
| 318,639 | 2/1920 | Germany | 123/196 M |

*Primary Examiner*—Wendell E. Burns
*Assistant Examiner*—David D. Reynolds

[57] ABSTRACT

A system for use within an internal combustion engine to facilitate the starting of the engine while cold. The system comprises a reservoir for holding a predetermined volume of lubricant, conduit means extending from the reservoir and having outlets positioned above a valve of each cylinder of the engine, and delivery means responsive to the actuation of the engine's starter for forcing lubricant at a predetermined substantially uniform rate from the reservoir and through the conduit means, whereby lubricant is delivered through the engine valves and cylinders, for the sealing thereof, continuously during the starting of the engine.

12 Claims, 1 Drawing Figure

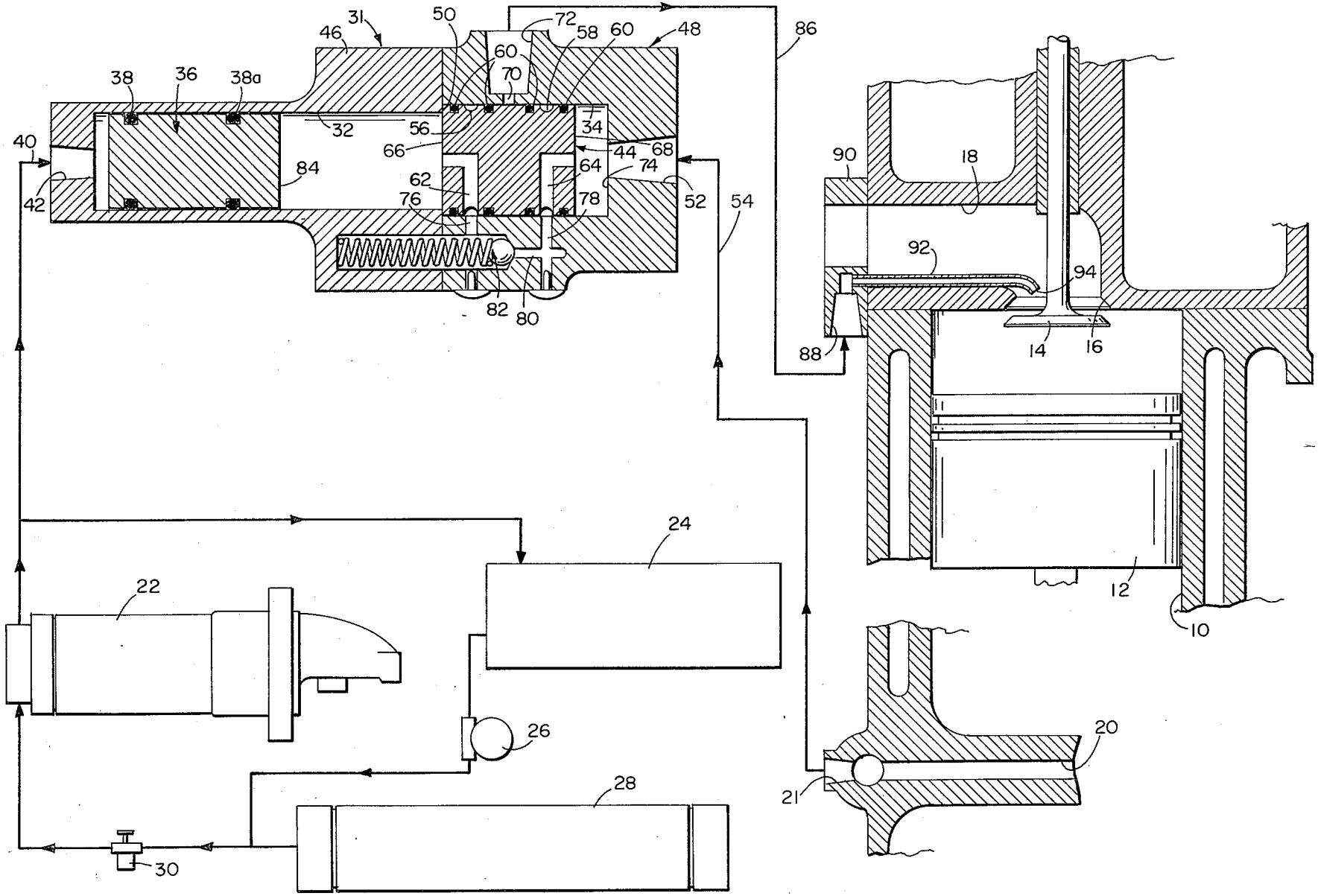
10
12
14
16
18
20
21
22
24
26
28
30
31
32
34
36
38
38a
40
42
44
46
48
50
52
54
56
58
60
62
64
66
68
70
72
74
76
78
80
82
84
86
88
90
92
94

COLD ENGINE STARTING

This is a continuation of application Ser. No. 472,353, filed May 22, 1974.

This invention relates to a system for facilitating the starting of internal combustion engines.

As is well known, most internal combustion engines have at least some difficulty in starting when they are cold. When they are exceptionally cold, as when exposed to an extremely low ambient temperature, the difficulty is further compounded. While this situation is always annoying, in various circumstances it represents a real hazard to human life. An example of the latter situation concerns the engines on the life boats conventionally employed on large ocean going vessels. Typically, these engines are exposed to extreme weather conditions and are left unused for long periods of time. When needed, however, it is usually imperative that these engines start immediately.

In view of the foregoing, it is a principal object of the present invention to provide a system for use with an overhead valve internal combustion engine which will materially improve the engine's ability to start while cold. It is a further object to provide such a system which is inexpensive to manufacture and is compatible with existing internal combustion engines. It is a further object to provide such a system which is entirely automatic in operation and requires no additional steps on the part of the user of the engine other than the normal engine starting and operating procedures.

To achieve these and other objects as shall further appear, a system constructed according to the present invention comprises a reservoir for holding a predetermined volume of lubricant, conduit means extending from the reservoir and having an outlet positioned above a valve of each engine cylinder, and delivery means responsive to the actuation of the engine's starter for forcing lubricant at a predetermined substantially uniform rate from the reservoir through the conduit means and out of those outlets. With such a system, lubricant is delivered to the valves and cylinders of the engine for the sealing thereof continuously during the starting of the engine.

In preferred embodiments of the invention the system includes means for automatically refilling the reservoir with lubricant after the engine has started. Where the lubricant is conventional crankcase oil, the last-mentioned means may comprise oil passages connecting the engine's conventional oil gallery with the reservoir, whereby oil pressure developed in the gallery during normal operation of the engine will force oil through the passages and into the reservoir. It is also preferred that the reservoir comprise a generally cylindrical recess in a first housing member. The delivery means may comprise a piston slidably mounted in that recess in substantially leak-proof engagement therewith and means for applying force to one side of the piston.

It is also preferred that valve means be provided for blocking the flow of oil to the reservoir from the oil gallery while the starter is being actuated and for blocking the flow of oil from the reservoir to the conduit means after a predetermined oil pressure has been reached in the oil gallery. Those valve means may comprise a chamber having openings which communicate with, respectively, the reservoir, an oil passage, and the conduit means. A slide member is provided in the chamber and is movable between a first position in which it establishes communication between the reservoir and the conduit means and blocks communication between the oil passage and the reservoir; and a second position in which it blocks communication between the reservoir and the conduit means and establishes communication between the oil passage and the reservoir. Oil pressure in the oil passage is operative, when a predetermined pressure level is reached, to move the slide member from the first position to the second position.

Other objects, features, and advantages of the invention will appear from the following description of a particular preferred embodiment, taken together with the accompanying drawing which is a partially schematic and partially fragmentary illustration of a system constructed according to the present invention for use with an internal combustion engine employing a hydraulic starter.

Referring to the drawing, a representative cylinder 10 and piston 12 of a conventional overhead valve diesel engine are shown as well as one of the valves 14 into the cylinder and the associated valve seat 16. A manifold 18 communicates with the cylinder 10 when the valve 14 is opened. The conventional oil gallery 20 of the engine is provided with a special outlet 21 for use as further described below.

The engine includes a hydraulic starter system including starter 22, hydraulic fluid tank 24, hydraulic pump 26, hydropneumatic accumulator 28, and starter valve 30 all interconnected by conventional hydraulic fluid lines as indicated in the drawing.

According to the invention, there is provided a unit 31 which comprises a housing having axially aligned cylindrical recesses 32, 34 therein. A piston 36 slides within the cylinder 32 and includes resilient circumferential seals **38, 38*a* disposed in appropriate recesses in the periphery of the piston. The portion of cylinder 32 to the left of piston 36 communicates with a hydraulic fluid line 40 connected to the output of hydraulic starter 22 via a port 42.**

A slide member 44 is provided in the cylinder 34 and is suitably sized for sliding motion therein. To simplify manufacture, the housing of the unit 32 is preferably made in separate first and second portions 46, 48 which incorporate the cylinders 32, 34 respectively. The cylinder 34 is of slightly larger diameter than cylinder 32 thereby providing an annular shoulder 50 at the interface of the cylinders which serves as a stop in the motion of the sliding slide member 44. A port 52 connects the right hand end of cylinder 34 with a conduit 54 leading from the outlet 21 of oil gallery 20.

The control valve 44 is provided with first and second circumferential recesses 56, 58, each enclosed by resilient seals 60 which are supported on the slide member 44 and seal against the surface of cylinder 34. The recesses 56, 58 communicate with channels 62, 64 respectively which open in the opposite end faces 66, 68 of the slide member 44. An outlet channel 70 and outlet port 72 communicate with the cylinder 34 at a longitudinal location such that the channel 70 will be aligned with the recess 56 in the slide member 44 when the end face 68 abuts the annular end face 74 at the right end of the cylinder 34. Channels 76, 78 are provided in the housing portion 48 at locations so as to be aligned with channels 62, 64 respectively when the slide member 44 abuts the shoulder 50. A cross channel 80 extends between channels 76, 78 and a ball check valve 82 is provided in that cross channel to permit fluid flow from channel 78 to channel 76 but to prevent fluid flow from channel 76 to channel 78.

The right-hand resilient seal 38*a* provided on piston 36 is set back from the right-hand end face 84 of that piston a sufficient distance such that the seal 38*a* will remain in contact with the wall of cylinder 32 even if the piston 36 should slide to the right, as viewed in the drawing, such that the end face 84 is in contact with end face 66 of slide member 44 while the end face 68 of the slide member is in contact with annular end face 74 in cylinder 34.

A fluid conduit 86 extends between the outlet port 72 and a port 88 provided in an adapter 90 inserted in the manifold 18. A conduit 92 extends from the port 88 within the manifold 18 and has an outlet 94 disposed closely above the valve seat 16. (Naturally similar conduit 92 having similarly placed outlets 94 would be provided for each cylinder 10 of the internal combustion engine.)

The operation of the apparatus may now be described. The description begins with the unit 31 in the configuration shown in the drawing and with an appropriate lubricant (e.g., oil identical to that contained in the oil gallery 20) filling the portion of cylinder 32 to the right of piston 36. The engine is assumed to be not running and indeed "cold" relative to its normal temperature levels which are achieved after a period of operation. As the starter valve 30 is depressed, hydraulic fluid under pressure from the accumulator 28 is delivered to the hydraulic starter 22 which "turns over" the engine. Fluid leaving the starter 22 may return, as is conventional, to hydraulic fluid tank 24 for subsequent pumping, after the engine has started, into the accumulator 28 so as to store hydraulic fluid under sufficient pressure to subsequently permit the operation of the starter 22 once again.

According to the present invention, an additional hydraulic fluid line 40 is provided which communicates with the left end of cylinder 32. In conventional marine internal combustion engine systems, the pressure of the hydraulic fluid in the line 40 will be from 50 to 80 p.s.i. during the cranking performed by the starter 22. This pressure causes the piston 36 to slide within cylinder 32. The resulting pressure is transmitted by the oil contained in that cylinder to cause the slide member 44 to slide to the right until its end face 68 abuts the annular end face 74 of cylinder 34. In this location, of course, the recess 56 is aligned with the outlet channel 70 so that the lubricant under pressure from the piston 36 may pass through the channel 62 into the recess 56 through the outlet channel 70 and into the line 86. The oil is thus quickly delivered to the conduit 92 and is dispensed above the valve seat 16 where, under the influence of gravity, it flows downwardly and quickly coats the appropriate sealing surfaces of the valve 14 and seat 16 as well as the walls of cylinder 10. The film of oil provided on the surfaces improves the sealing capability and thereby increases the compression, particularly in a cold diesel engine. Furthermore, it is believed that this film of oil insulates the hot compressed air and vaporized fuel mixture from the cold metal surfaces of the engine and thereby accelerates the heat build-up required for proper operation of the internal combustion engine.

As will be apparent to those skilled in the art, the rate of delivery of oil may be controlled by the appropriate choice of limiting conduit dimensions in the path of oil flow between the unit 31 and the cylinder 10. This is most easily done by the choice of the size of the outlet 94 in tube 92. While a range of oil delivery rates is possible for the achievement of satisfactory results, it will be appreciated by those skilled in the art, that too little oil will fail to adequately coat the appropriate surfaces and too much oil can cause an extreme back pressure in the portion of the cylinder above the piston 12 which could damage the piston connecting rods and even the crank shaft of the engine. Because the size and shape of the appropriate surfaces to be coated varies from engine to engine, exact rates of deliveries of oil are impossible to give.

The volume of cylinder 32 is chosen, in relation to the oil delivery rate (as set by the size of oil outlet 94) such that sufficient oil is retained in the cylinder 32 for continuous delivery of oil to the cylinders over a time period which includes many strokes of the piston 12. This assures a continuous and constant delivery of oil during the starting attempt rather than a single "one-shot" delivery of oil to the cylinder 10 prior to the starting of the engine.

After the engine has started, the operator naturally releases the starter valve 30 thus relieving the pressure in the line 40 and, consequently, the delivery of oil to the valves 14 and pistons 10 of the engine. As the engine operates, the pressure in the oil gallery 20 builds up (e.g., in marine engines typically to a level of 40–60 p.s.i.). This pressure is transmitted via the conduit 54 to the end face 68 of slide member 44 thus causing that valve to slide to the left until the end face 66 abuts the shoulder 50. In this position of the slide member 44, oil from the conduit 54 may flow through channels 64, 78, 80, 76 and 62 into the cylinder 32. The oil pressure forces the piston 36 to the left while refilling the cylinder 32 with a reservoir of oil available for delivery to the engine cylinders 10, as described above, the next time the engine is to be started.

While a particular preferred embodiment of the invention has been illustrated in the accompanying drawing and described in detail herein, other embodiments are within the scope of the invention and the following claims.

What is claimed is:

1. In an overhead valve diesel engine including a starter system for starting said engine, a cylinder, and a cylinder valve and seat for controlling the flow of a fluid between the exterior and the interior of said cylinder, a system to improve the diesel engine's ability to start while cold comprising a reservoir for holding a predetermined volume of lubricant conduit means communicating with said reservoir and having an outlet positioned above said valve for delivering lubricant directly to the sealing surfaces of said valve and seat whereby, at least partly under the influence of gravity, it flows downwardly to coat said sealing surfaces without substantial dilution by the fluid which the valve controls, and delivery means responsive only to the operation of said starter system during the starting of said engine for forcing lubricant continuously from said reservoir, through said conduit, and out of said outlet during and only during the operation of said starter system.

2. The system of claim 1 wherein said reservoir has a recess and said delivery means comprises a member movable between first and second positions in said recess, with said lubricant being on a first side of said member and means for moving said member from said first toward said second position during the operation of said starter system.

3. The system of claim 2 wherein means are provided for automatically refilling said reservoir with lubricant after the engine has started.

4. A system for use with an internal combustion engine including a starter, a cylinder, and a cylinder valve to improve the engine's ability to start while cold, the system comprising a reservoir for holding a predetermined volume of lubricant, said reservoir having a recess, conduit means extending from said reservoir and having an outlet positioned above said cylinder valve of said engine, delivery means responsive to the operation of said starter for forcing lubricant at a predetermined uniform rate from said reservoir and through said conduit means and out of said outlet, said delivery means comprising a member movable between first and second positions in said recess, said lubricant being on a first side of said member and means for moving said member from said first toward said second position during the operation of said starter, whereby lubricant is delivered to said valve and engine cylinder for the sealing thereof continuously during the operation of said starter of said engine, said lubricant being conventional crankcase oil and said last-mentioned means comprising an oil passage connecting the oil gallery of said engine with said reservoir, whereby oil pressure developed in said oil gallery during normal operation of the engine will force oil through said passage and into said reservoir.

5. The system of claim 4, further including valve means for blocking the flow of oil to said reservoir from said oil gallery while said starter is operated and for blocking the flow of oil from said reservoir to said conduit means after a predetermined oil pressure has been reached in said oil gallery.

6. A system for use with an internal combustion engine including a starter, a cylinder, and a cylinder valve to improve the engine's ability to start while cold, the system comprising a reservoir for holding a predetermined volume of lubricant comprising a generally cylindrical recess in a first rigid housing member, conduit means extending from said reservoir and having an outlet positioned above said cylinder valve of said engine, delivery means responsive to the operation of said starter for forcing lubricant at a predetermined uniform rate from said reservoir and through said conduit means and out of said outlet, said delivery means comprising a member movable between first and second positions in said recess in substantially leak-proof engagement therewith with said lubricant being on a first side of said member and means for moving said member from said first toward said second position during the operation of said starter, means for substantially refilling said reservoir with lubricant after the engine has started, said lubricant comprising conventional crankcase oil and said last mentioned means comprising an oil passage connecting the oil gallery of said engine with said reservoir whereby oil pressure developed in said oil gallery during normal operation of said engine will force oil through said passage and into said reservoir, and valve means for blocking the flow of oil to said reservoir from said oil gallery while said starter is operated and for blocking the flow of oil from said reservoir to said conduit means after a predetermined oil pressure has been reached in said oil gallery;

whereby lubricant is delivered to said valve and engine cylinder for the sealing thereof continuously during the operation of said starter of said engine.

7. The system of claim 6 wherein said valve means comprise a chamber having first, second and third openings communicating, respectively, with said reservoir, with said oil passage, and with said conduit means, and said movable member comprising a slide member in said chamber movable between a first position in which it establishes communication between said reservoir and said conduit means and blocks communication between said oil passage and said reservoir and a second position in which it blocks communication between said reservoir and said conduit means and establishes communication between said oil passage and said reservoir, oil pressure in said passage operative when a predetermined level is reached to move said slide member from said first position to said second position.

8. The system of claim 7 wherein said chamber is formed in a second rigid housing member secured to said first rigid housing member.

9. The system of claim 7 wherein said chamber and said slide member are each generally cylindrical.

10. The system of claim 7 wherein said slide member defines a first lubricant channel linking said reservoir and said third opening when said slide member is in said first position.

11. The system of claim 10 wherein said chamber is formed in a second rigid housing member secured to said first rigid housing member, said slide member including a second lubricant channel and said second housing member having a channel therein, said second lubricant channel communicating with said oil passage and said channel in said second housing member linking said first and second lubricant channels when said slide member is in said second position.

12. The system of claim 11 wherein a check valve is provided in said channel in said second housing member which permits flow therethrough only toward said first lubricant channel.

* * * * *